US005405736A

United States Patent [19]

Young

[11] Patent Number: 5,405,736

[45] Date of Patent: Apr. 11, 1995

[54] DYE STABILITY WITH SOLID COUPLER SOLVENT

[75] Inventor: David J. Young, Chorleywood, United Kingdom

[73] Assignee: Eastman Kodak Company, Rochester, N.Y.

[21] Appl. No.: 996,289

[22] Filed: Dec. 23, 1992

[30] Foreign Application Priority Data

Jan. 21, 1992 [GB] United Kingdom ..... 9201235

[51] Int. Cl.[6] ..... G03C 7/32

[52] U.S. Cl. ..... 430/546; 430/449; 430/377; 430/551; 430/610

[58] Field of Search ..... 430/546, 222, 601, 377, 430/610, 449, 551

[56] References Cited

U.S. PATENT DOCUMENTS

| | | | |
|---|---|---|---|
| 2,353,262 | 7/1944 | Peterson et al. | 430/546 |
| 2,768,894 | 10/1956 | Harriman et al. | 95/6 |
| 2,835,579 | 5/1958 | Thirtle et al. | 96/97 |
| 3,788,857 | 1/1974 | Van Poucke et al. | 96/100 |
| 4,324,856 | 4/1982 | Kawakatsu et al. | 430/601 |
| 4,419,441 | 12/1983 | Nittel et al. | 430/546 |
| 4,686,177 | 8/1987 | Aoki et al. | 430/553 |
| 4,774,166 | 9/1988 | Sasaki et al. | 430/376 |
| 4,857,449 | 8/1989 | Ogawa et al. | 430/546 |
| 4,970,139 | 11/1990 | Bagchi | 430/449 |
| 5,006,453 | 4/1991 | Takahashi et al. | 430/546 |
| 5,008,179 | 4/1991 | Chari et al. | 430/546 |
| 5,176,989 | 1/1993 | Morigaki et al. | 430/546 |
| 5,200,303 | 4/1993 | Takahashi et al. | 430/546 |
| 5,342,746 | 8/1994 | Zengerle et al. | 430/546 |

FOREIGN PATENT DOCUMENTS

| | | |
|---|---|---|
| 137722 | 4/1985 | European Pat. Off. . |
| 143570 | 6/1985 | European Pat. Off. . |
| 145342 | 6/1985 | European Pat. Off. . |
| 0276319 | 8/1988 | European Pat. Off. . |
| 0280238 | 8/1988 | European Pat. Off. . |
| 0422505 | 4/1991 | European Pat. Off. . |
| 422595 | 4/1991 | European Pat. Off. . |
| 0426043 | 5/1991 | European Pat. Off. . |
| 0447969 | 9/1991 | European Pat. Off. . |
| 49-029461 | 3/1974 | Japan . |
| 56-41098 | 9/1981 | Japan . |
| 61-075349 | 4/1986 | Japan . |
| 2-277050 | 11/1990 | Japan . |
| 1285254 | 8/1972 | United Kingdom . |
| 91/08515 | 6/1991 | WIPO . |

*Primary Examiner*—Richard L. Schilling
*Attorney, Agent, or Firm*—Gordon M. Stewart

[57] ABSTRACT

The invention provides a photographic dispersion for inducing dye stability in the eventual photographic product. The invention provides in a first aspect a photographic dispersion comprising a photographic coupler and a solvent therefore wherein the solvent is solid at its temperature of fade concern thereby to promote dye stability in use.

The invention also provides a photographic coupler and a solvent therefor wherein the solvent is an alkyl alcohol or an optionally substituted dialkyl or diaryl phosphate. The coupler may have a ballasted chain having a matched molecular structure thereby to further promote dye stability in use.

15 Claims, No Drawings

DYE STABILITY WITH SOLID COUPLER SOLVENT

FIELD OF THE INVENTION

The invention relates to the improvement of dye stability, and particularly to the improvement of dye stability in photographic dye images both when exposed to light and when stored in the dark.

BACKGROUND OF THE INVENTION

It has long been known that dye images fade especially in sunlight and despite work over the years to improve dye stability further improvement is required.

Various approaches have been attempted to improve dye stability in the finished photographic product. For example in U.S. Pat. No. 2,353,262 (Kodak) it is disclosed that the admixture of a coupler and a non-coupling compound of a similar structure reduces crystallization. Crystallization is believed to be one cause of lack of dye stability in the finished product.

Later in GB-A-1,285,254 (Konishiroku) there is disclosed the use in a photographic process of a photographic coupler along with a solvent of a similar structure. This arrangement improved crystallization characteristics, Dmax and contrast when compared to systems without the solvent.

U.S. Pat. No. 4,774,166 (Fuji) discloses the use of ballasted alcohols which are said to improve photographic activity.

Further EP-A-0,426,043 (Fuji) reveals high viscosity coupler solvents which can be solid in use, however none of the forgoing disclosures are directed specifically to the improvement of dye stability in the finished photographic product.

It would be desirable then, to provide photographic products which have good dye stability.

SUMMARY OF THE INVENTION

We have now found that dye stability in photographic products can be improved by applying to the design of the coupler and coupler solvent system at least one of the following system design features. It will be appreciated that in any of the systems 1,2 or even 3 design features may be present, since each feature although distinct may overlap or be coincident with one or two of the other features.

A first feature therefore of the present invention is to provide a photographic dispersion comprising a photographic coupler and a solvent therefor characterized in that the solvent is solid at its temperature of fade concern. This will normally be ambient temperature being the temperature at which finished photographic products are normally stored. However for specialized purposes the temperature of fade concern can be as high as 85° C. or may in some circumstances be as low as +5° C.

Another feature of the invention is to provide a photographic dispersion comprising a photographic coupler and a solvent therefor characterized in that the coupler solvent is a long chain aliphatic compound and the coupler has the ballasted chain having a matched molecular structure thereby to promote dye stability in use.

A further feature of the invention is to provide a photographic dispersion comprising a coupler and a coupler solvent therefor characterized in that the solvent has a high solvatochromic parameter $\beta$ value. The solvatochromic parameter $\beta$ indicates the hydrogen bond accepting ability of the solvent compounds. Examples of such compounds are high molecular weight alcohols, lauramides such as diethyl lauramide, acetanilides such as N-n-butylacetanilide, or higher molecular weight phosphates such as trihexyl phosphate or tri-(2-ethylhexyl)phosphate.

EMBODIMENTS OF THE INVENTION

According specifically to the present invention therefore, there is provided a photographic dispersion adapted for the improvement of image dye stability against fading in a photographic element, which comprises a photographic solvent and coupler system, wherein the coupler solvent is selected from:

1. a straight or branched chain substituted or unsubstituted alkyl alcohol, or
2. a straight or branched chain substituted or unsubstituted dialkyl or diaryl phosphate;

wherein the coupler solvents are solid at the temperature of fade concern, and have a melting point no higher than the melting point of the coupler with which they are to be used.

In a preferred form of the invention the solvent is preferably solid below 60° C. and most preferably solid below 25° C. The solvent may be a high molecular weight aliphatic compound or high molecular weight compounds optionally including a phosphate group. Preferably the aliphatic compound has from 12–20 carbon atoms and most preferably about 16 carbon atoms.

The coupler may be selected from those having a high molecular weight ballasted chain of 12–20 carbon atoms.

The alkyl alcohol or dialkyl or diaryl phosphate may respectively be selected from compounds of the formula (I) or (II) below:

$$\mathrm{ROH} \qquad \text{(I)}$$

$$R^1O-\overset{\overset{\displaystyle O}{\|}}{\underset{\underset{\displaystyle OR}{|}}{P}}-OH \qquad \text{(II)}$$

wherein R is a straight or branched substituted or unsubstituted aryl or alkyl group; with the proviso that when $R^1=R$ neither of R or and $R^1$ are hydrogen.

The coupler should preferably dissolve readily in, and not react with, the "solid solvent" when warm to temperatures up to the melting point of the coupler, and the solution should remain homogeneous on cooling to room temperature. Thus the coupler and solvent system should not separate into separate phases and neither the solvent nor the coupler should form crystals any more readily than does the coupler in conventional liquid solvents such as dibutylphthalate or tricresylphosophate.

The combined coupler and solvent system should remain solid at the temperatures of fade concern for coupler and dye stability.

Examples of alkyl alcohols useful in the practice of this invention are given below with their melting points. The list is illustrative not exhaustive.

| | | Melting Point |
|---|---|---|
| 1. | 10-fluoro-1-decanol | 22 |

-continued

| | | Melting Point |
|---|---|---|
| 2. | 6-undecanol | 25 |
| 3. | 1-dodecanol | 26 |
| 4. | 6-dodecanol | 30 |
| 5. | 1-tridecanol | 33 |
| 6. | 1-tetradecanol | 39–40 |
| 7. | 1-pentadecanol | 45–46 |
| 8. | 1-hexadecanol | 50 |
| 9. | 1-heptadecanol | 54 |
| 10. | 2-heptadecanol | 54 |
| 11. | 9-heptadecanol | 61 |
| 12. | 1-octadecanol | 58.5 |
| 13. | trans-9-octadecen-1-ol $[CH_3(CH_2)_7CH{=}CH(CH_4)_8OH]$ | 36–7 |
| 14. | 1-nonadecanol | 62–3 |
| 15. | 1-eicosanol $[C_2OH_{41}OH]$ | 65.5 |
| 16. | 2-eicosanol | 50.7 |
| | di-alcohols | |
| 17. | 1,12-tridecane diol $CH_3CH\ OH(CH_2)_{11}OH$; | 60–61 |
| 18. | 1,13-tridecane diol $HO(CH_2)_{13}OH$; and | |
| 19. | tridecamethylene glycol | 76.5 |

Additionally the alkyl alcohols of the invention may include halogen substituted alkyl alcohols with one or more double bond; thiols and trialcohols; and mixtures of the above. Further the coupler solvents, of the invention may include d-, l-, dl-, optical isomers of compounds having an asymmetric carbon centre.

Suitable phosphates for use as coupler solvents in accord with the present invention include.

| | Coupler Solvent | Melting Point |
|---|---|---|
| 20. | dimethyl phosphate | 90 |
| 21. | bis(2,4,6 trichloro-3-methylphenyl-phosphate | 94.5 |
| 22. | bis (4-bromo-3-methylphenyl phosphate | 106–8 |
| 23. | [4-(1,1,3,3-tetramethylbutyl)-phenyl]methylphosphate | 94 |
| 24. | 2-naphthyl phenyl phosphate | 92–93 |
| 25. | (4-chloro-3-methylphenyl) phenyl phosphate | 31–33 |
| 26. | (4-bromobenzyl) benzyl phosphate | 91 |
| 27. | (2-methylphenyl) phenyl phosphate | 46–47 |
| 28. | bis (4-isopropylphenyl) phosphate | 75 |
| 29. | bis [4-(1,1,3,3)-tetramethylbutyl) phenyl]phosphate | 74 |
| 30. | bis (4-n-octylphenyl) phosphate | 39 |
| 31. | benzyl dodecyl phosphate | 48–50 |
| 32. | 2-chloro-1-(2',4'-dichlorophenyl)-vinylethylphosphate | 108–9 |
| 33. | octadecyl octyl phosphate | 58–59.5 |
| 34. | hexadecyl decyl phosphate | 57–58 |
| 35. | tetradecyl octyl phosphate | 46–46.5 |
| 36. | n-dodecyl n-octyl phosphate | 41–42 |
| 37. | n-dodecyl n-heptyl phosphate | 38–39 |
| 38. | n-dodecyl n-hexyl phosphate | 34–36 |
| 39. | n-dodecyl 3-chloro-n-propyl phosphate | 40–41.5 |
| 40. | di-t-butyl phosphate | 83–84 |
| 41. | bis(2-phenylethyl) phosphate | 57 |
| 42. | dibenzyl phosphate | 79–80 |
| 43. | n-hexadecyl-benzyl phosphate | 58–60 |
| 44. | bis(4-methylbenzyl) phosphate | 88 |
| 45. | phenyl(4-chlorophenyl) phosphate | 105 |
| 46. | di-p-tolyl phosphate | 76–81 |
| 47. | phenyl p-tolyl phosphate | 54 |
| 48. | bis(2,2,2-trichloroethyl) phosphate | 77–84 |
| 49. | dicyclohexyl phosphate | 78–80 |
| 50. | dinonyl phosphate | 34–36 |

-continued

| | Coupler Solvent | Melting Point |
|---|---|---|
| 51. | n-hexadecyl-n-pentyl phosphate | 45–47 |
| 52. | n-hexadecyl-ethyl phosphate | 54–55 |
| 53. | dioctadecyl phosphate | 79–81 |
| 54. | dihexadecyl phosphate | 74–75 |
| 55. | ditetradecyl phosphate | 68 |
| 56. | didodecyl phosphate | 53–55 |
| 57. | diundecyl phosphate | 54 |
| 58. | (2-bromoethyl) hexadecyl phosphate | 50–52 |
| 59. | didecyl phosphate | 48–49 |
| 60. | dioctyl phosphate | 30 |
| 61. | diallyl phosphate | 95–100 |
| 62. | diphenyl phosphate | 67–69 |

The photographic element can be a single color element or a multicolor element. In a multicolor element, the magenta dye-forming coupler combinations of this invention would usually be associated with a green-sensitive emulsion, although they could be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively. The element can contain additional layers, such as filter and barrier layers.

In the following discussion of suitable materials for use in the emulsions and elements of this invention, reference will be made to Research Disclosure, December, 1989, Item 308119, published by Industrial Opportunities Ltd., The Old Harbourmaster's 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

The elements of the invention can include couplers as described in Research Disclosure Section VII, paragraphs D, E, F and G and the publications cited therein. The coupler combinations of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilizers (see Research Disclosure of Section VI), antistain agents and image dye stabilizer (see Research Disclosure of Section VII, paragraphs I and J), light absorbing and scattering materials (see Research Disclosure of Section VIII), hardeners (see Research Disclosure of Section X), plasticizers and lubricants (see Research Disclosure of Section XII), antistatic agents (see Research Disclosure of Section XIII), matting agents (see Research Disclosure of Section XVI), and development modifiers (see Research Disclosure of Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulphonamido)-ethylaniline sulphate hydrate, 4-amino-3-methyl-N-ethyl-N-$\beta$-(methanesulphonamido)ethyl-N,N-diethylaniline hydrochloride and 4-amino-N-ethyl-N-(2-methoxyethyl)-m-toluidine di-p-toluene sulphonate.

With negative-working silver halide emulsions this processing step leads to a negative image. To obtain a positive (or reversal image), this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The invention will now be described with reference to the following Examples which are included by way of illustration only:

EXAMPLE 1

A yellow-forming dispersion containing a coupler of the formula:

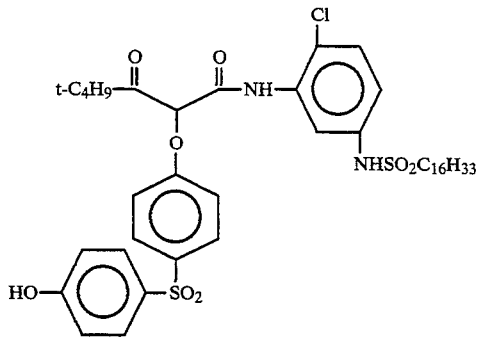

was made up with hexadecanol as a main solvent and compared with a conventional solvent di butylphthalate.

A range of six dispersions at varying concentrations were made with each solvent and with various surfactants namely Alkanol XC or Aerosol OT; both being conventional surfactants, or with SA1 and SA2 which are novel sulphosuccinate surfactants forming the subject of British Patent Application No. 88 17811.6 and being of the formula

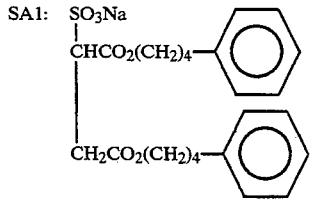

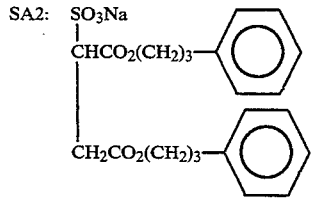

The dispersions in accordance with the invention contained the coupler as set forth above at 33 g/kg dispersion in admixture with the 12 solvent systems set out in Table 1 below.

The dispersions so formed were coated with a blue sensitized silver chloride emulsion to give a coupler coverage of 0.54 g/m$^2$, a silver coverage of 0.2 g/m$^2$, and a gelatine coverage of 1.61 g/m$^2$; on a resin coated paper support as a single layer. Over this was coated a super coat of 1.0 g/m$^2$ of gelatine and the whole was hardened with bis vinyl sulphonyl methylether at a rate of 2% of the total gelatine.

Exposure was through a neutral density step tablet and processing was standard (Kodak RA4).

| | | | Means (blue record) | | | | Droplet Sizes |
|---|---|---|---|---|---|---|---|
| Main Solvent | Surfactant | wgt/kg | Dmin | Dmax | Contrast | Speed | Microns |
| Hexadecanol | Alkanol XC | 8.8 g | | | | | .216 |
| | Aerosol OT | 8.8 g | | | | | .184 |
| | SAI | 8.8 g | .102 | 2.27 | 2.73 | 166 | .216 |
| | SAI | 17.6 g | | | | | .146 |
| | SA2 | 8.8 g | | | | | .192 |
| | SA2 | 17.6 g | | | | | .139 |
| Di-butyl- | Alkanol XC | 8.8 g | | | | | .119 |

-continued

| Main Solvent | Surfactant | wgt/kg | Means (blue record) Dmin | Dmax | Contrast | Speed | Droplet Sizes Microns |
|---|---|---|---|---|---|---|---|
| phthalate | Aerosol OT | 8.8 g | | | | | .102 |
| | SAl | 8.8 g | .102 | 2.25 | 2.73 | 166 | .120 |
| | SAI | 17.6 g | | | | | .092 |
| | SA2 | 8.8 g | | | | | .106 |
| | SA2 | 17.6 g | | | | | .074 |

Thus, there was not significant difference in the fresh sensometry between the coatings containing hexadecanol and those containing di butylphthalate.

EXAMPLE 2

Some of the photographic elements in Example 1 were then exposed to fading conditions as shown below in Table 2.

| Solvent | Means of 6 coatings-light faded | | | | | |
|---|---|---|---|---|---|---|
| | 50K Lux HID (+UV) filter)* 7 days | | | | | |
| Hexadecanol | $\Delta D_{1.7}$ | $\Delta D_{1.0}$ | $\Delta D_{0.5}$ | | | |
| Di-butylphthalate | −.443 | −.347 | −.272 | | | |
| Δ (Hexadecanol- | −.562 | −.403 | −.300 | | | |
| di-butylphthalate) | .119 | .056 | .028 | | | |
| | ****5.4K Lux SANS | | | | | |
| | 28 days | | | 84 days | | |
| Hexadecanol | $\Delta D_{1.7}$ | $\Delta D_{1.0}$ | $\Delta D_{0.5}$ | $\Delta D_{1.7}$ | $\Delta D_{1.0}$ | $\Delta D_{0.5}$ |
| Di-butylphthalate | −.253 | −.163 | −.118 | −.817 | −.523 | −.303 |
| Δ (Hexadecanol- | −.307 | −.183 | −.133 | −.962 | −.593 | −.330 |
| di-butylphthalate) | .054 | .020 | .015 | .145 | .070 | .027 |

Significance $1\sigma \cong .01 \left( \sigma \cong \frac{\sigma}{\sqrt{n-1}} \right)$

*HID = High Intensity Daylight
** = Density decreases from an initial density of 1.7 1.0 and 0.5 respectively
***Δ (Hexadecanol-di butylphthalate) shows the difference between the reduction of dye density for hexadecanol and that for di butylphthalate.
****SANS is simulated average north sky light.

Thus the hexadecanol containing sample shows a significantly improved fade resistance compared with the system containing di butylphthalate as a solvent at ambient temperature.

EXAMPLE 3

The products of Example 1 were also held in the dark for up to 70 days at various temperatures the results are shown in Table 3.

TABLE 3

| Solvent | Means of 6 coatings - dark faded 60 C./60% RH 70 days | 60 C./40% RH 70 days | 85 C./40% RH 35 days |
|---|---|---|---|
| Hexadecanol | $\Delta D_{1.7}$ | $\Delta D_{1.7}$ | $\Delta D_{1.7}$ |
| Di-butylphthalate | −.077 | −.072 | −.495 |
| Δ(Hexadecanol- | −.056 | −.052 | −.388 |
| di-butylphthalate) | −.021 | −.020 | −.107 |

It thus appears that at temperatures of over 60° C. there was no improvement in fade resistance using hexadecanol as a solvent.

A similar situation was also found for the "contrast loss" during raw stock keeping at 60° C. However this result was quite different if the temperature was reduced to 50° C. (i.e. below the melting point of hexadecanol) as shown in Table 4 below.

TABLE 4

| Solvent | Means of 6 coatings - raw stock incubation 50 0 C./50% RH 2 weeks ΔBlue contrast | 60 C./40% RH 1 week ΔBlue contrast |
|---|---|---|
| Hexadecanol | | |
| Di-butylphthalate | −.422 | −.620 |
| Δ(Hexadecanol- | −.548 | −.625 |
| di-butylphthalate) | −.126 | .005 |

EXAMPLE 4

Under the same conditions as in Example 1 a photographic element was produced using dicetyl phosphate instead of hexadecanol as the solvent choice.

The results are given in Table 5 below and show that in general results obtained for hexadecanol are repeated for those of diecetyl phosphate.

TABLE 5

| Solvent | Dye light fade $\Delta D_{1.7}$ | $\Delta D_{1.0}$ | $\Delta D_{0.5}$ |
|---|---|---|---|
| | HID 7 days | | |
| di-cetyl phosphate | −.46 | −.36 | −.28 |
| di-butylphthalate | −.562 | −.403 | −.300 |
| Δ(dicetyl- phosphate- di-butylphthalate) | .10 | .04 | .02 |
| | SANS 28 days | | |
| di-cetyl phosphate | −.23 | −.16 | −.12 |
| di-butylphthalate | −.307 | −.183 | −.133 |
| Δ(dicetyl- phosphate- di-butylphthalate) | .08 | .02 | .01 |
| | SANS 84 days | | |
| di-cetyl phosphate | −.81 | −.48 | −.28 |
| di-butylphthalate | −.962 | −.593 | −.330 |
| Δdicetyl- phosphate- di-butylphthalate) | .15 | .11 | .05 |

TABLE 5-continued

| Solvent | Dye dark fade 70 days 60 C./60% RH $\Delta D_{1.7}$ | 70 days 60 C./40% RH $\Delta D_{1.7}$ | 35 days 85 C./40% RH $\Delta D_{1.7}$ |
|---|---|---|---|
| di-cetyl phosphate | −.09 | −.02 | −.60 |
| di-butylphthalate | −.056 | −.052 | −.388 |
| Δ(dicetyl-phosphate-di-butylphthalate) | −.03 | .03 | −.21 |

| Solvent | Raw Stock Incubation 2 weeks 50 C./50% RH ΔBlue contrast | 1 week 60 C./40% RH ΔBlue contrast |
|---|---|---|
| di-cetyl phosphate | −.31 | −.32 |
| di-butylphthalate | −.548 | −.625 |
| Δ(dicetyl-phosphate-di-butylphthalate) | .24 | .30 |

EXAMPLE 5

Subsequently comparison was made of photographic elements made as described in Example 1 with the following solvents:

1. di-butyl phthalate; liquid at ambient temperatures
2. hexadecanol solid below 54° C.
3. dicetyl phosphate solid at 74° C.

These were tested as in Example 3 and the results are shown in Table 6 below.

TABLE 6

| Main Solvent | 60 C./40% RH Blue Dmin 1 wk | 2 wks | 60 C./40% RH ΔBlue contrast 1 wk | 2 wks |
|---|---|---|---|---|
| di-butylphthalate | .171 | .330 | −.625 | −.897 |
| hexadecanol | .197 | .386 | −.620 | −.918 |
| dicetyl phosphate | .102 | .216 | −.32 | −.52 |

It can be seen that the hexadecanol shows no advantage over di-butyl phthalate but dicetyl phosphate shows a clear improvement over both. This is, it is believed, because the dicetyl phosphate is solid at 60° C.; whereas the hexadecanol is liquid.

The interpretation of these results is rendered difficult because the precise mechanisms whereby the improvement in dye stability is achieved are not fully understood. However it is possible that hexadecanol being solid at room temperature (melting point 54° C.) provides a rigid matrix for the dye and/or the coupler. This could slow the ingress of fading species and reduce the vibrational/rotational energy of the dye and/or the coupler. These conditions are likely to reduce fading reaction rates.

This hypothesis receives some support from a further coating done at the same time as those described above from the results shown in Table 5.

Further it appears that the novel solvents in accordance with the present invention show significant image and incubation advantages when tested below their melting points. There seems to be no significant advantage above the melting points of the solvents concerned.

Since the two novel solvents have higher melting points than the control solvent and every advantage in fading is seen when the control solvent is liquid and the novel solvent is solid it seems likely that it is the solidity of the solvent at the temperature of fade concern which is important. Again this proposition is also supported by the Examples.

Further both the novel solvents have high $\beta$ values i.e. high hydrogen bond accepting abilities which is a function of the solvents selected. This effect could be synergised because the solvents selected are molecularly matched with the ballasted coupler.

The solvents in accordance with the present invention are straight and branched long chain alcohols preferably alkyl alcohols and the defined phosphates having relatively high melting points. Such solvents particularly if solid at the temperature of fade-concern may derive their fade resistant effects because any such solvent causes droplets in the oil dispersion to be solid under the required conditions.

What is claimed is:

1. A photographic dispersion adapted for the improvement of dye stability against fading in a photographic element, which comprises a coupler solvent and a coupler, characterized in that the coupler solvent is a straight or branched chain substituted or unsubstituted dialkyl or diaryl phosphate;

wherein the coupler solvent is solid below 60° C. and has a melting point no higher than the melting point of the coupler with which it is used.

2. A photographic dispersion according to claim 1 wherein the dialkyl or diaryl phosphate has the formula (II)

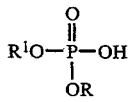

(II)

wherein R and $R^1$ are each a straight or branched chain substituted or unsubstituted alkyl or aryl group.

3. A photographic dispersion according to claim 1 wherein the coupler solvent is a long chain phosphate and wherein the coupler has a ballasted chain having a matched molecular structure to promote dye stability.

4. A photographic dispersion according to claim 1 wherein the solvent is solid below 25° C.

5. A photographic dispersion according to claim 1 wherein the solvent has from 12 to 20 carbon atoms.

6. A photographic dispersion according to claim 1 wherein the solvent has about 16 carbon atoms.

7. A photographic dispersion according to claim 3 wherein the coupler has a high molecular weight ballast chain, said ballast chain having from 12 to 20 carbon atoms.

8. A photographic dispersion according to claim 1 wherein the coupler solvent is dicetyl phosphate.

9. A photographic element comprising a photographic dispersion as claimed in claim 1.

10. A photographic element comprising a photographic dispersion as claimed in claim 3.

11. A photographic element comprising a photographic dispersion as claimed in claim 4.

12. A method of improving dye stability against fading in a photographic element, which comprises forming a photographic element containing a photographic dispersion which dispersion comprises a coupler solvent and a coupler, wherein the coupler solvent is a straight or branched chain substituted or unsubstituted dialkyl or diaryl phosphate which is solid at the storage temperature and has a melting point no higher than the melting point of the coupler with which it is used, and storing the element under conditions which cause dye fading.

13. A method according to claim 12 wherein the coupler has a ballasted chain of 12 to 20 carbon atoms.

14. A method according to claim 12 wherein the solvent is solid below 60° C.

15. A method according to claim 12 wherein the coupler has a high molecular weight ballast chain, said ballast chain having from 12 to 20 carbon atoms.

* * * * *